United States Patent [19]

Bumgarner, Sr.

[11] 4,232,491

[45] Nov. 11, 1980

[54] SWIMMING POOL DECK

[76] Inventor: John C. Bumgarner, Sr., 514 N. Crain Hwy., Glen Burnie, Md. 21061

[21] Appl. No.: 949,537

[22] Filed: Oct. 10, 1978

[51] Int. Cl.[3] ..... E04B 1/35; E04H 3/16; E04H 3/18

[52] U.S. Cl. ..... 52/169.7; 4/506

[58] Field of Search ..... 52/169.7; 4/172, 172.19

[56] References Cited

U.S. PATENT DOCUMENTS

| | | | |
|---|---|---|---|
| 3,072,921 | 1/1963 | Hegerfeld | 4/172.19 |
| 3,371,455 | 3/1968 | Fox | 4/172.19 |
| 4,109,324 | 8/1978 | Cornelius | 52/169.7 |

*Primary Examiner*—John E. Murtagh

[57] ABSTRACT

A swimming pool deck is disclosed for construction with new swimming pool installations and with existing swimming pools. A concrete base is poured around the exterior wall of the swimming pool at or below the frost line and a plurality of vertical hollow columns are spaced in the concrete base. A plurality of X-shaped braces are spaced in the concrete base to join together connecting vertical walls which are positioned next to the exterior pool wall. Horizontal support rods extend from the vertical walls to the hollow columns. The area around the pool is back-filled to the proper level and reinforcing grates are connected to the horizontal support rods. A concrete deck is poured with some of the concrete filling the hollow columns.

The swimming pool deck fabrication method and apparatus of the invention employs straight-forward sequence of frame and pouring form erection without requiring skilled labor for any precisely dimensional excavation, leveling or the like. Moreover, the completed deck has internal mechanical integrity, and is relatively immune to displacement of the surrounding back-fill attributable to freezing, thaw, erosion or the like.

3 Claims, 4 Drawing Figures

SWIMMING POOL DECK

BACKGROUND OF THE INVENTION

This invention relates to swimming pool decks and, more particularly to an improved swimming pool deck arrangement, and apparatus and methodology for constructing such decks.

In prior art methods and apparatus for constructing a swimming pool deck, the deck was formed in one of several methods. Older construction methods generally consisted of excavating to a depth of 4–6 inches around the peripheral area of the swimming pool and placing a form the distance from the pool according to the desired width. Concrete was poured into the excavated area. This type of swimming pool deck is disclosed by Bennett in U.S. Pat. No. 2,954,645. After a couple of years use, with the ground around the pool settling and winter freezes, the concrete deck begins to crack and settle.

A second construction method is disclosed by Fox—U.S. Pat. No. 3511.002 where a lined swimming pool and deck are formed as a unit. An excavation is dug wide enough for the pool and deck construction. The pool is formed of metal sides with a plastic liner. The deck is constructed of a plurality of supporting members anchored to a footing with a poured concrete deck. This type of deck must be installed as the pool is built since the supporting members also add support to the pool walls.

A third type of swimming pool deck is disclosed by Colson—U.S. Pat. No. 4,015,379 where the deck and pool are constructed at the same time. Colson excavates an area large enough for the pool and deck and pours a bottom for the pool and footings for the deck. Appropriate reinforcing rods are placed in the excavation prior to pouring the pool bottom and deck footings. The walls of the pool are poured to finish the pool. The deck is constructed by pouring a plurality of spaced columns placing supports between the columns. The supports are anchored to the reinforcing rods in the pool walls and to horizontal supports extending radially outward from the pool. Reinforcing grids are placed on the horizontal supports and the area outside the pool is back-filled to the proper grade. The deck is finished by pouring concrete to fill the area formed above the supporting apparatus and confined by mold forms. The Colson method requires the deck to be assembled as the pool is being built since the supports are anchored to the pool molds and to the reinforcing rods.

It is the principle object of this invention to provide an improved swimming pool deck arrangement and an improved method and apparatus for constructing such a deck.

More specifically, it is an object of the present invention to provide a swimming pool deck construction for forming a deck by mechanical assembly of a deck reinforcing support system.

It is another object of the present invention to form a swimming pool deck either with a new pool construction or with an existing pool.

It is a further object of the present invention that the swimming pool deck erection is effected by a mechanical prescribed rote process to fabricate a deck to match a pool of any desired shape without requiring skilled artisans for excavation, concrete installation, or the like.

SUMMARY OF THE INVENTION

The concrete swimming pool deck of this invention is constructed by excavating the area outside of the pool wall to a depth below the frost line and pouring a footing in the bottom of the excavated area. A plurality of spaced vertical support molds and support members are anchored in the concrete. Between the support members and the pool wall is positioned a plurality of connecting vertical walls. Attached to the vertical walls and to the vertical supports are a plurality of spaced horizontal reinforcing rods which have L-shaped bends for extending into the vertical supports. The area around the pool is back-filled to the level of the vertical support molds and support members. Reinforcing grids are placed on the support members and earth, and concrete is poured to the desired level.

DESCRIPTION OF THE PREFERRED EMBODIMENT

Figure 1:
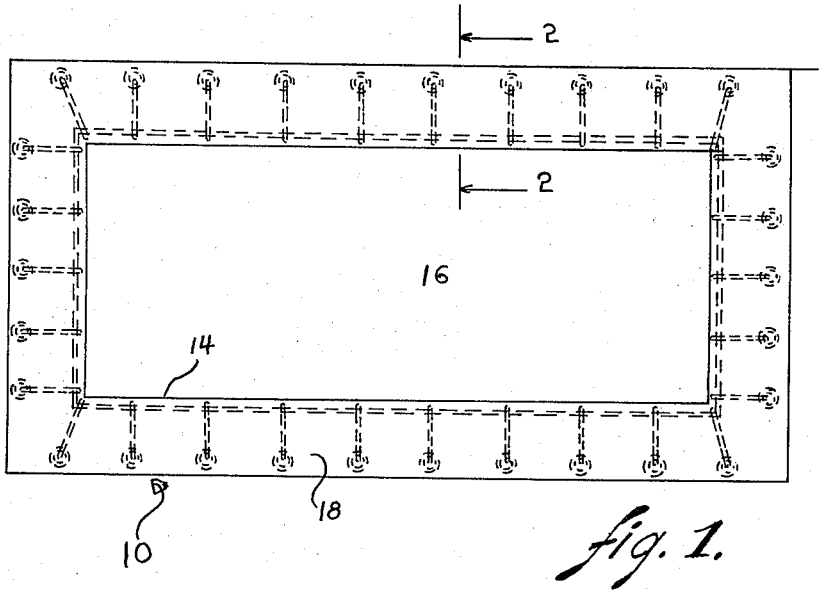
FIG. 1 is a top plan view of an exemplary configuration of a swimming pool having side walls and a deck and other features embodying the principles of the present invention.

The exemplary pool 10 shown in FIG. 1 comprises sidewalls 14, a bottom 16, and a deck 18 which is illustrated as extending around the entire periphery of the pool. If desired, however, only certain portions of the periphery of the pool may be provided with a deck. The sidewalls 14 and bottom 16 are formed from poured concrete. In accordance with normal construction, one end of the pool my be provided with a deepened portion to facilitate diving from a diving board, not shown.

The pool 10 may be an existing structure or one formed simultaneously with the construction of the decking 18. In either case the pool may be an in the ground pool or an above the ground pool around which earth will be back-filled.

Figure 2:
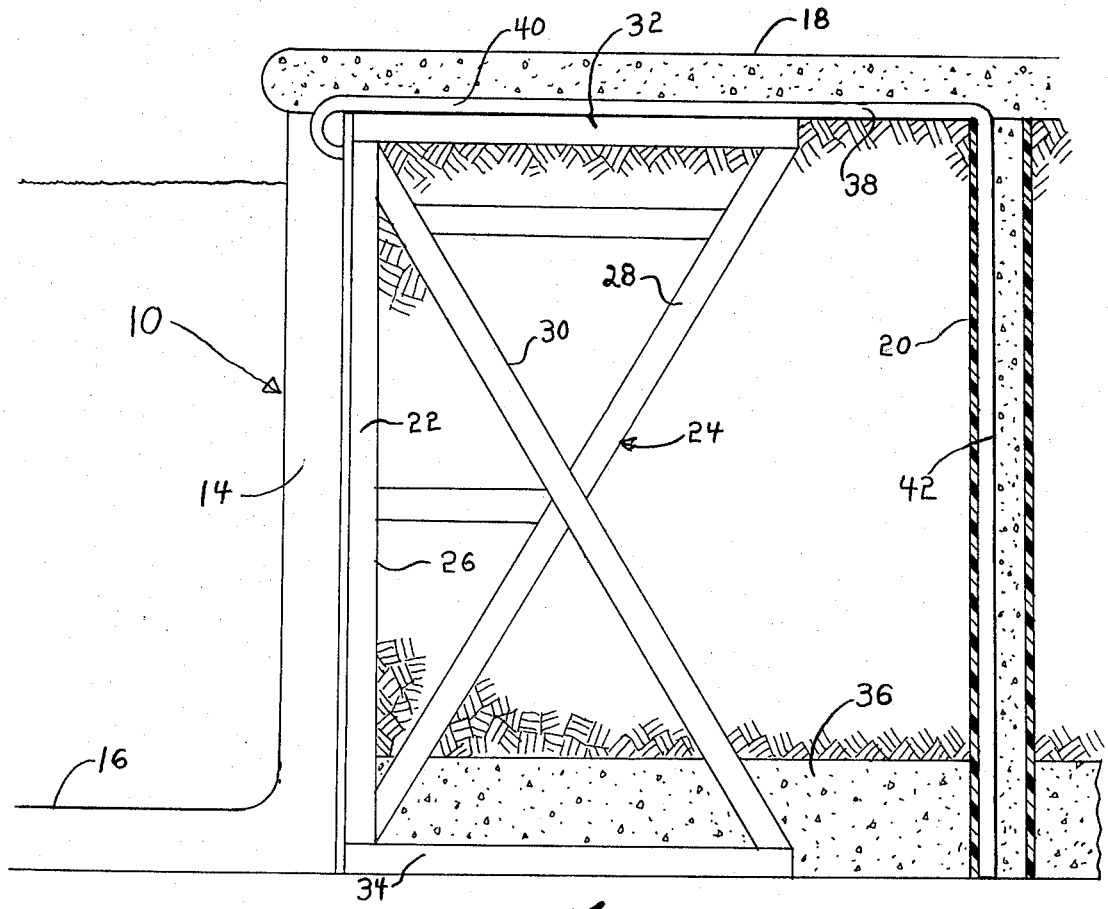
FIG. 2 is a sectional view of the swimming pool deck of this invention taken along the line 2—2 of FIG. 1.
Figure 4:
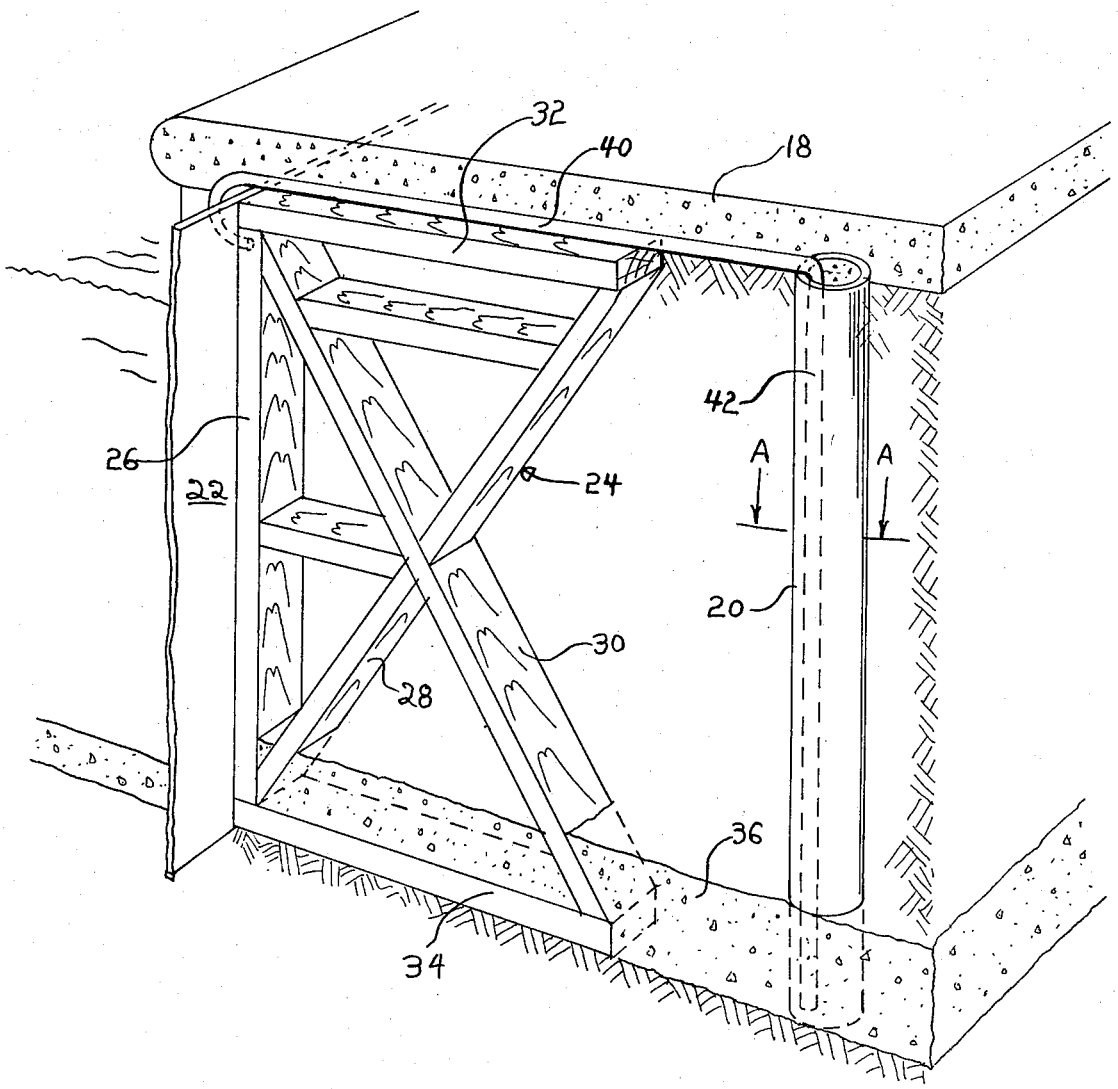
FIG. 4 is an isometric view of the section of the swimming pool deck of the invention in FIG. 2.

Referring now to FIGS. 2 and 4, there is shown in crosssectioned form, side and perspective views, respectively illustrating a section of the swimming pool 10, formed in accordance with the well-known principles of swimming pool construction, and a swimming pool deck 18 formed in accordance with the principles of the present invention, and also the apparatus and methodology employed to construct the deck. As a first step in the deck fabrication, the earth is excavated around an existing swimming pool to below the frost line. This may or may not be the same level as the bottom 16 of the pool since one end of the pool may be deeper than the other. Likewise, the earth may not be excavated completely around the periphery of the pool in that the deck may not be desired around the entire periphery. The excavation need not be accurate as to lateral form, and variances in the shape or location of the final depth of excavation is not critical. Thus the excavation may be readily effected by bulk earth moving equipment without requirement for attention to fine detail by a skilled operator providing the operator exercises care not to strike the pool wall 14.

After the excavation is completed, a plurality of spaced vertical hollow support-molds 20 are drivin into the earth approximately 4 to 5 feet apart and 2 to 3 feet from the pool side wall 14. The hollow support-molds 20 may be formed of a synthetic plastic tube such as vinyl choloride which is about 4 inches in diameter. A plurality of connecting vertical walls or plates 22 are placed against the exterior surface of the pool side wall 14 and cross-shaped supporting frames 24 hold the plates 22 against the pool. The cross-shaped supporting frame 24, shown in FIG. 2, includes a vertical leg 26, which abuts the plate 22, and cross legs 28 and 30 held together by horizontal supports 32 and 34. When all of the plates 22 and cross-shaped support frames 24 are in place, a concrete footing 36 is poured, securing the support-molds 20, plates 22 and cross-shaped support frames in place. The support-molds 20 and cross-shaped frames 24 are positioned such that imaginary lines radiating from the pool will align them with one another as shown in FIG. 1. The cross-shaped frames 24 may be constructed of any suitable materials which will withstand heavy loads such as wood, reinforced precast concrete, steel or plastic.

Secured to the plates 22 and extending to the support-molds 20 are reinforcing rods 38. The horizontal support 32 of cross-shaped supports 24 support the reinforcing rods 38 to prevent the rods from sagging. The reinforcing rod 38 has an L-shaped bend as shown in FIG. 2, forming a horizontal leg 40 and a vertical leg 42. Leg 42 extends into support-mold 20.

Figure 3:
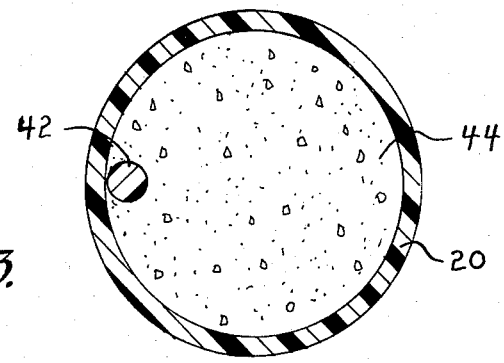
FIG. 3 is a sectional view of the vertical mold of FIG. 4 taken along the line A—A of FIG. 4.

To complete the mechanical swimming pool deck assembly before concrete pouring, the earth is back-filled to cover all of the supporting assembly. During the back-filling step the support-molds 20 are capped to prevent them from being filled with earth. Once the back-filling is complete, the caps, not shown, are removed and wire mesh reinforcing grids, not shown, are secured to the reinforcing rods 38. There is a remaining excavated area above the mechanical assembly which can be defined by a mold form and swimming pool coping. Concrete is poured in the remaining excavated area and into the hollow support-molds 20. When the concrete 44 in the support-molds 20 sets, the leg 42 of reinforcing rod 38 is cemented in place. The final construction of the support-mold 20, leg 42 and concrete 44, shown in FIGS. 2 and 3, form a rigid unit.

It is observed that the pool deck 18 reinforced and supported by the mechanical assembly which includes: footings 36, concrete filled support-molds 20, cross-shaped supports 24, and reinforcing rod 38. It thus has internal integrity, is self-supportive and does not rely for such purposes upon the back-fill. Thus, heaving of the loosely packed back-fill by freezing, thawing or the like does not produce substantial upward displacing forces on the upper platform or deck which would tend to create cracks or dislocations of the deck 18.

In those situations where a new swimming pool is being constructed it is advantageous to install the deck before the area around the pool is back-filled completely. Earth is back-filled around to a height just below the frost line and the above methodology and apparatus are used to install a deck. Instead of using vertical plates 22, it is contemplated, particularly in new pool construction, to embed the reinforcing rods 38 in the side wall 14 of the pool.

The above arrangement, apparatus and methodology has thus been shown to form a deck of structural integrity for new and existing swimming pools, which is assembled by a rote prescribed sequential installation of mechanical frame members and the like. The deck is created without requiring the labor of skilled artisans for critical earth excavations, multiple levelings, or the like. Decks of the instant construction formed by the present technology may thus be readily formed at relatively low cost.

The above apparatus and method are merely illustrative of the principles of the invention. Numerous modifications and adaptations thereof will be readily apparent to those skilled in the art without departing from the scope and spirit of the invention.

What is claimed is:

1. In combination in apparatus for fabricating a swimming pool deck comprising; a concrete footing, a plurality of spaced vertically disposed hollow tubular support molds filled with concrete, embedded in the concrete footings, a plurality of spaced supports abutting the exterior surface of a side wall of an existing swimming pool and embedded in the concrete footings, and a plurality of vertical plates positioned next to the exterior surface of the side walls of the existing swimming pool and the spaced supports have a vertical leg to hold said vertical plates in place, a plurality of horizontal reinforcing rods extending from the side wall of the existing swimming pool to the vertically disposed hollow tubular support molds to support a poured concrete deck, said hollow tubular support means are speced from one another and from the side wall of the existing swimming pool, each of the horizontal reinforcing rods having a hook portion on one end to engage the top portion of the vertical plates, and an elongated vertically disposed downwardly extending L-shaped portion on the other end, said downwardly extending portion embedded in the concrete in the hollow tubular support molds.

2. A combination as in claim 1 wherein the spaced supports are aligned with the vertically disposed hollow tubular support-molds filled with concrete.

3. A combination as in claim 2 wherein the spaced supports include cross-shaped legs and horizontal supports.

* * * * *